United States Patent [19]

Davidson

[11] 4,221,014

[45] Sep. 9, 1980

[54] POST STORAGE RACK

[75] Inventor: Samuel L. Davidson, Winnsboro, La.

[73] Assignee: Mastercrafters Corporation, Winnsboro, La.

[21] Appl. No.: 33,338

[22] Filed: Apr. 25, 1979

[51] Int. Cl.[3] ..... B63B 35/00

[52] U.S. Cl. ..... 9/1.1; 9/7; 211/60 R

[58] Field of Search ..... 9/11, 1.7, 7, 400; 211/60 R, 60 G, 60 T, 62, 63, 64, 65

[56] References Cited

U.S. PATENT DOCUMENTS

| | | | |
|---|---|---|---|
| 1,348,619 | 8/1920 | Zycki | 211/62 |
| 2,787,315 | 4/1957 | Siebert | 9/7 |
| 2,974,329 | 3/1961 | Welch | 9/1.1 |
| 3,007,618 | 11/1961 | Davis et al. | 211/65 X |
| 3,193,228 | 7/1965 | Chion | 9/1.7 X |
| 3,642,320 | 2/1972 | Ward | 9/7 X |
| 3,745,702 | 7/1973 | Ogawa | 211/60 R X |
| 3,886,611 | 6/1975 | Lammy et al. | 9/7 |
| 3,913,746 | 10/1975 | Burton | 211/64 |
| 4,062,299 | 12/1977 | Smith | 9/1.7 |

*Primary Examiner*—Douglas C. Butler
*Attorney, Agent, or Firm*—Donald A. Kaul

[57] ABSTRACT

A storage rack is mounted on boats of the type having seats supported by pedestals in order to store the pedestal posts. The storage rack is adapted to be mounted angularly for holding a pair of pedestal posts and consists of a pair of elongated cylindrical tubes, mounted side-by-side, and having a forward mounting plate and a rear support plate. The forward mounting plate is mounted angularly with respect to the cylindrical members so that when the mounting plate is attached to a mounting surface, the cylindrical members are disposed angularly. The support plate extends perpendicularly with respect to the tubular members and is provided with an opening or hole in alignment with each tubular member to prevent water accumulation and to accomodate the reduced diameter portion of the pedestal posts.

5 Claims, 6 Drawing Figures

POST STORAGE RACK

This invention relates to a storage unit or storage rack and more particularly it relates to a storage rack adapted for use on a boat of the type which has seats mounted on pedestals with removable pedestal posts, in order to receive and store such posts when they are disconnected from the seats.

While there are many situations wherein elongated objects, such as extension posts, must be stored until needed, prior types of storage arrangements for such posts have not proved altogether satisfactory. This is particularly true in the case of marine environments wherein post pedestals are used, primarily on fishing boats, for elevating the seats or casting chairs. On such fishing boats, the pedestal used to elevate a seat or chair above the boat deck consists of a base unit attached to the deck, a spider unit attached beneath the seat, and an elongated post which is removably interposed between the spider and base units to elevate the seats. During fishing operations, the seats are elevated by the use of such post pedestals, but when the seats are lowered for running, the posts themselves must be adequately stored within the confined areas on the boat.

In the past, such posts have been stored by the use of spring-type clips into which the posts are inserted when not in use. However, because the posts themselves are made of steel or other metal, the combination of the weight of the posts and the jarring movement of the boat often causes the spring clips to lose their resiliency over a period of time. Unless the posts are properly and firmly mounted, there is the chance that they could fall free while the boat is in use, thus causing possible injury to personnel on the boat or, as a minimum, damage to the posts themselves.

While numerous types of storage units for elongated objects are known, ranging from cases or racks for objects such as pool cues, fishing rods and the like, none of these appear particularly advantageous for use in connection with heavy metal posts, which must be mounted in a confined area such as a boat.

It is, therefore, an object of the present invention to overcome the difficulties and deficiencies associated with prior forms of storage units or racks which make them unsatisfactory for marine use, and to provide instead, a new and improved form of storage rack for posts or other objects, which storage racks finds particular adaptability for use on boats.

Another object of the present invention is to provide an improved form of posts storage rack which can be easily mounted in a confined area, such as a boat, and which is capable of receiving and retaining elongated posts or other objects.

Other objects, advantages and salient features of the present invention will become apparent from the following detailed description, which, taken in conjunction with the annexed drawings, discloses a preferred embodiment thereof.

Referring now to the drawings which form a part of this original disclosure:

The foregoing objects are attained by providing a post storage rack consisting of a pair of elongated cylindrical tubes, attached at their forward end to an enlarged mounting plate and attached at their rear end to a support plate. Such attachment at the forward and rear ends thus serves to assure that the cylindrical tubular members will be retained in their parallel disposition. The forward end of the cylindrical members is cut or slanted at an acute angle with respect to the axis of elongation, such that when the mounting plate is attached, it likewise is disposed at an acute angle with respect to the axis of elongation of cylindrical members. In contrast, the support plate, mounted at the rear of the cylindrical members, is disposed perpendicularly to the axis of elongation thereof. The mounting plate is provided with a pair of apertures, each coextensive with the bore of the cylindrical members to enable the posts to be quickly and easily inserted and removed. Holes formed about the perimeter of the mounting plate can be used to attach the mounting plate and hence the entire storage rack to a suitable supporting surface, preferably a vertical supporting surface. Holes are provided in the mounting plate at the rear of the cylindrical members to assure that no water will inadvertently accumulate therein, and additionally, to receive and accommodate the reduced diameter portions of the posts.

Figure 1:
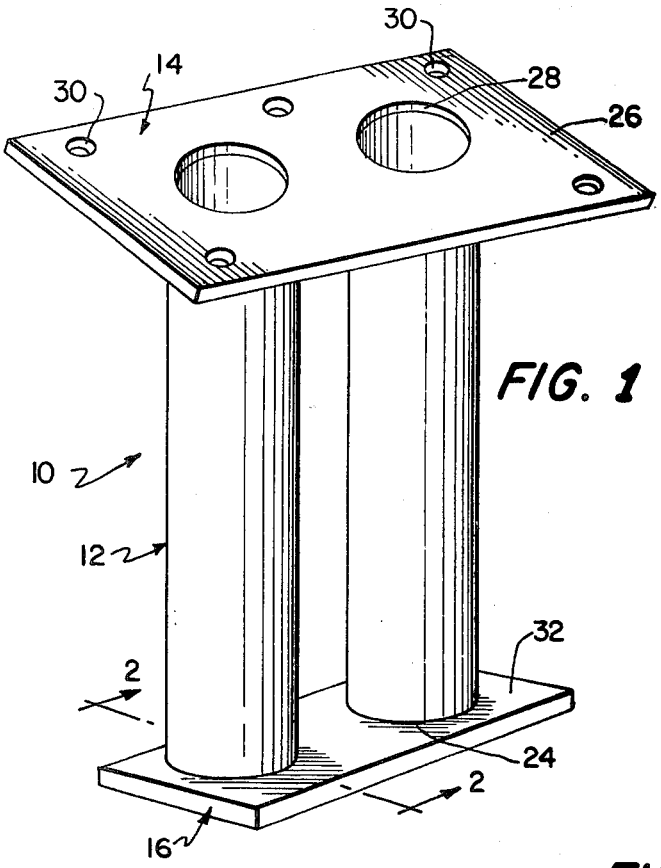
FIG. 1 is a perspective view of the post storage rack of the present invention.

Referring now to the drawings in further detail, there is illustrated in FIG. 1 a post storage rack in accordance with the principles of the present invention, such rack being generally designated 10. The storage rack 10 includes axially elongated tubular means generally designated 12, a mounting plate generally designated 14 and a support plate or abutment means generally designated 16.

Figure 2:
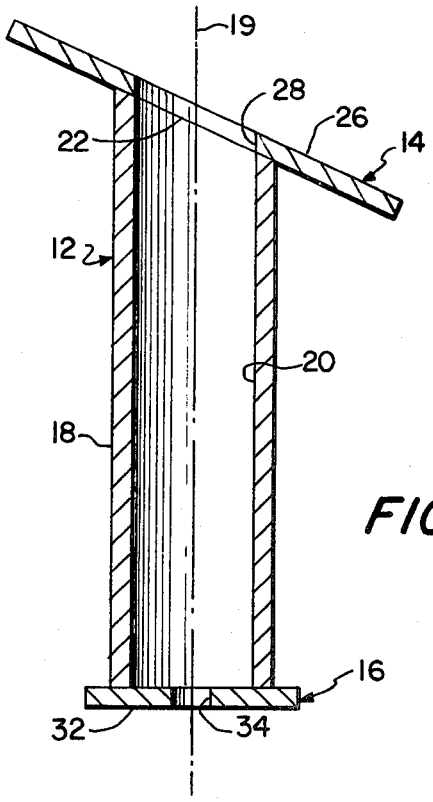
FIG. 2 is a longitudinal sectional view thereof taken along the line 2—2 of FIG. 1.

The axially elongated tubular member means 12 consists of a pair of right cylindrical members 18 elongated along a central axis of elongation designated 19 in FIG. 2. The cylindrical members 18 have a central bore 20 formed therein. The forward end 22 of each cylindrical member 18 is disposed at an acute angle with respect to the axis of elongation 19. The rear end 24 of each right cylindrical member is disposed perpendicularly with respect to the axis of elongation 19. Obviously, since the tubular means of cylindrical member 18 is formed as a right cylinder, the central bore 20 is circular in cross-sectional configuration.

Figure 3:
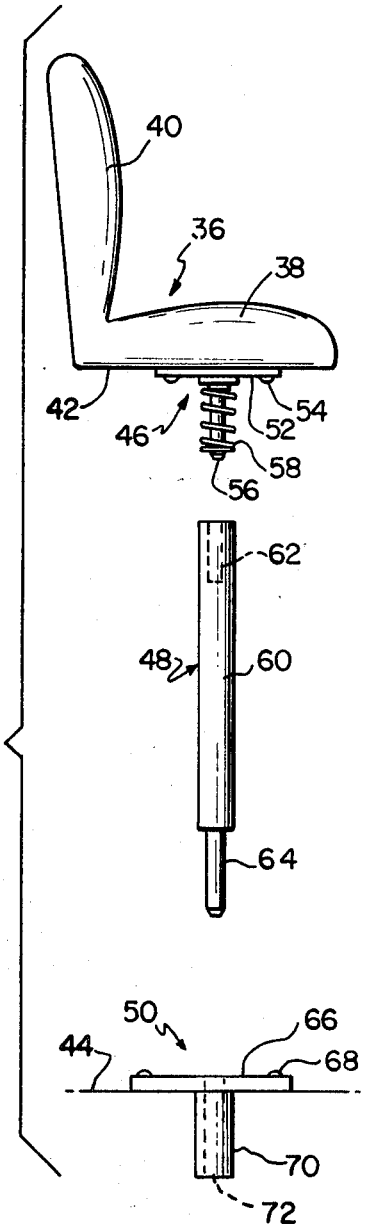
FIG. 3 is an exploded view illustrating a boat seat and pedestal post unit.

The mounting plate 14 consists of a flat metallic plate 26 having a pair of large apertures or aperture means 28 formed therein in side-by-side relationship. The size of the aperture 28, which is circular, corresponds with, and is likewise aligned with, the central bore 20 in each cylindrical member 18. As a result, as illustrated in FIG. 3, the aperture means and the central bore are coextensive. A series of countersunk holes 30 are formed about the periphery of the mounting plate 26 to enable the plate, and the remainder of the storage rack 10 attached thereto, to be mounted, preferably with the mounting plate being disposed in vertical disposition.

The support plate 16 consists of a flat metal plate 32 attached at the rear end 24 of the cylindrical members.

As a result, the inner surface of the plate 32 acts as an abutment surface against which any posts which are inserted into the storage rack are able to rest. A pair of holes or hole means 34 are provided in the support plate 32, centrally aligned with the central bore 20 of each of the cylindrical members 18. These holes 34 assure that no water accumulation will take place within the storage rack, and additionally, can provide for reception of any small projection which might be provided at the end of a post to be stored.

As can best be seen from FIG. 2, the mounting plate 26 projects beyond the tubular members 18 to thus serve as a strong and effective mounting surface for enabling the storage rack to be mounted in its desired position.

If attention is directed to FIG. 3, there is shown therein a seat generally designated 36 of the type used on fishing boats. The seat 36 includes a bottom portion 38 and an upright back portion 40. The underside 42 of the bottom portion is spaced away from the deck 44 of the boat by the pedestal means which includes a spider generally designated 46, a post generally designated 48, and a base generally designated 50.

The spider 46 includes a flat plate 52 connectable by screws 54 to the underside 42 of the seat. A rod 56 depends from the plate 52 and is surrounded by a coil compression spring 58. The post 48 includes a main body portion 60 having a blind end bore 62 at the upper end thereof and a reduced diameter portion 64 at the lower end thereof. The base 50 includes a plate 66 attached by screws 68 onto the deck 44. It also includes a depending shaft 70 having a bore 72 therein. If desired, a bushing can be installed in the bore 72.

Figure 4:
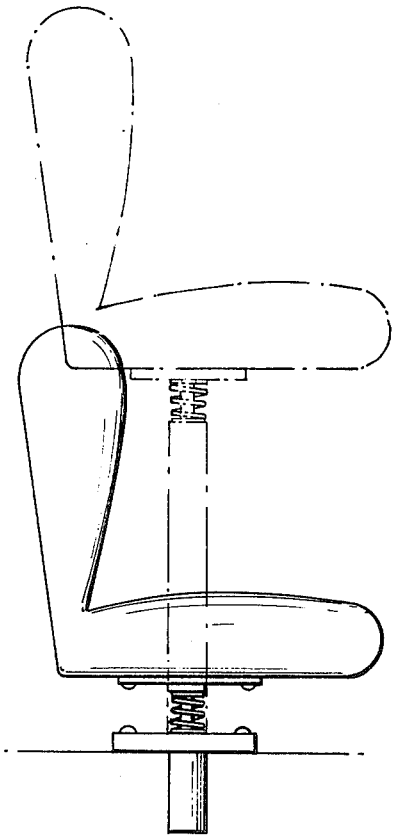
FIG. 4 is a view showing in solid lines the boat seat as mounted with the pedestal post and showing in phantom lines the boat seat as mounted without the post.
Figure 6:
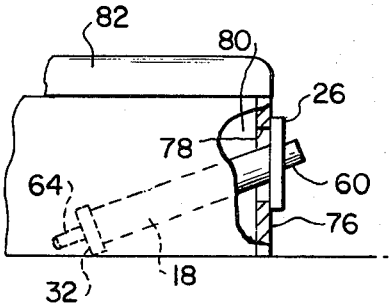
FIG. 6 is a diagrammatic view illustrating the manner of attachment and use of the post storage rack.

As shown in FIG. 4, when the seat 36 is lowered for running, the spider rod 56 inserts directly into the bore 72 in the base shaft 70 or in the bushing in the base shaft 70. The spring 58 abuts against the top of the base shaft 70 to thus cushion the seat against shocks. When the seat is in this lowered position, the pedestal post 60 can be stored in the storage rack 10. On the other hand, when the seat 36 is raised for fishing, the post 48 is installed between the spider and the base. Specifically, the spider rod 56 fits into the post bore 62 while the reduced diameter portion 64 of the post fits into the bore 72 in the base shaft 70 or in the bore within the bushing in such base shaft. This arrangement is illustrated in phantom lines in FIG. 4.

Figure 5:
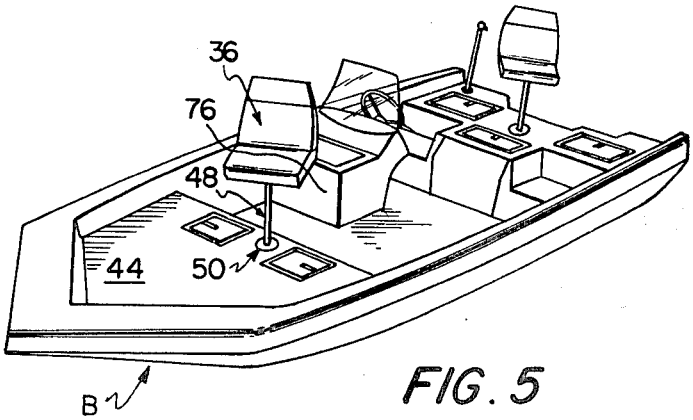
FIG. 5 is a diagramamtic view of a boat having a seat supported by a post pedestal.

A typical boat B of the type to which the present invention is addressed is shown in FIG. 5. The seats 36 are shown in their elevated positions and the pedestal post 48 are thus obviously not stored.

The storage rack 10 is advantageously mounted in position along a vertical wall 76 of the boat. An opening 78 formed in the wall 76 permits the storage rank to be mounted in a compartment 80 beneath a seat cushion 82. The opening 78 permits passage of the support plate 16 and the two attached tubular members 12 but the plate 26 is of greater size than the opening 78 and it thus abuts against the portion of the wall 76 which peripherally surrounds the opening. The post 48 is installed in one of the tubular members 12 of the storage rack, with the reduced diameter portion 64 of the post projecting through the opening 34 in the support plate. The upper end of the post body portion 60 projects somewhat beyond the plate 26 to enable the post to be manually grasped and removed.

Finally, the mounting plate 26 provides a smooth surface which can carry suitable indicia such as the manufacturer's name or other information concerning the vessel on which the storage rack is used.

As an alternative to having the support plate 16 (which serves as a plate mounting means), disposed augularly with respect to the wall 76 (which serves as a wall mounting means), the wall 76 may be sloped, and the plate 76 connected perpendicularly to the tubular members. In either instance the sloped relation is such that the posts remain in position as the boat moves forwardly and stops under normal operation.

Various changes and modifications apparent to those skilled in the art may be made without departing from the spirit and scope of the invention as defined in the appended claims.

What is claimed is:

1. In combination with a boat of the type having generally vertically disposed interior wall means with a space therebehind, and also having at least one seat adapted to be supported on pedestal means, wherein said pedestal means includes at least one elongated removable post, the improvement which comprises:

storage rack means mounted upon said boat;

said storage rack means including a tubular member adapted to receive and store said elongated post when it is removed from the pedestal means;

said storage means further including abutment means which engages said elongated post when disposed in said tubular member;

said abutment means causing only an end portion of said post to project partially beyond said storage rack means to permit said projecting end portion which projects beyond said storage rack means to be grasped for removal of said post from storage rack means;

said storage rack means further including plate means secured to and extending laterally of said tubular member, said plate means being mounted on said generally vertically disposed interior wall means;

said tubular member extending generally rearwardly and downwardly from said wall means to said space therebehind.

2. The improvement defined in claim 1 wherein said post includes a reduced diameter portion and wherein said abutment means includes an aperture through which said reduced diameter portion extends when said post is disposed in said tubular member.

3. In combination with a boat of the type having generally vertically disposed interior wall means with a space therebehind, and also having at least two seats adapted to be supported on respectively separate pedestal means, wherein said pedestal means includes at least first and second separate elongated removable posts, the improvement which comprises:

storage rack means mounted upon said boat;

said storage rack means including first and second tubular members adapted to receive and store said first and second elongated posts respectively when said posts are removed from said pedestal means;

said abutment means causing only an end portion of said posts to project partially beyond said storage rack means to permit said projecting end portion which projects beyond said storage rack means to be grasped for removal of said posts from said storage rack means;

said storage rack means further including plate means secured to and extending laterally of said tubular members, said plate means being mounted on said generally vertically disposed interior wall means;

said tubular members extending generally rearwardly and downwardly from said wall means into said space therebehind.

4. The improvement defined in claim 3 wherein said generally vertically disposed wall means has an opening therein, and wherein said plate means is mounted on said wall means in covering relation to said opening with said tubular members extending through said opening into said space behind said wall means.

5. The improvement defined in claim 14 wherein said plate means is a parallelogram plate, wherein said tubular members are cylinders having an interior dimension greater than the diameter of said posts, wherein said plate has side-by-side apertures therein, and wherein said cylinders are secured to said plate means in alignment with said apertures whereby said posts can be inserted into said cylinders with said end portion projecting beyond said plate.

* * * * *